United States Patent [19]

Miers

[11] Patent Number: 4,908,123

[45] Date of Patent: Mar. 13, 1990

[54] METHOD AND APPARATUS FOR REMOVING RELATIVELY DENSE FOREIGN MATERIALS FROM SHREDDED PAPER

[75] Inventor: Robert M. Miers, Appleton, Wis.

[73] Assignee: Kimberly-Clark Corporation, Neenah, Wis.

[21] Appl. No.: 852,671

[22] Filed: Apr. 16, 1986

[51] Int. Cl.[4] ..... B07B 4/00

[52] U.S. Cl. ..... 209/133; 209/139.1; 209/143

[58] Field of Search ..... 209/12, 20, 44.1, 44.2, 209/133, 143, 477, 139.1, 137

[56] References Cited

U.S. PATENT DOCUMENTS

| | | | |
|---|---|---|---|
| 913,377 | 2/1909 | Grant | 209/133 |
| 2,047,568 | 7/1936 | Lissman | 209/133 |
| 2,617,531 | 11/1952 | Palmer | 209/143 |
| 2,815,860 | 12/1957 | Krantz et al. | 209/20 |
| 3,441,131 | 4/1969 | Gebauer | 209/139.1 |
| 3,907,670 | 9/1975 | Fernandes | 209/134.1 |
| 4,010,097 | 3/1977 | Murray et al. | 209/139.1 |

FOREIGN PATENT DOCUMENTS

| | | | |
|---|---|---|---|
| 526238 | 10/1921 | France | 209/137 |
| 593422 | 5/1959 | Italy | 209/133 |
| 341879 | 5/1970 | U.S.S.R. | 209/143 |
| 413294 | 7/1934 | United Kingdom | 209/137 |

*Primary Examiner*—Donald T. Hajec
*Attorney, Agent, or Firm*—Gregory E. Croft

[57] ABSTRACT

An air separator for removing relatively dense foreign materials from shredded paper comprises a downwardly pitched inlet duct which causes relatively dense particles to impact the wall of a vertical discharge duct and deflect downward for removal while the shredded paper follows the air flow through a horizontal outlet duct.

8 Claims, 1 Drawing Sheet

METHOD AND APPARATUS FOR REMOVING RELATIVELY DENSE FOREIGN MATERIALS FROM SHREDDED PAPER

BACKGROUND OF THE INVENTION

In developing a process for dry deinking of wastepaper by fiberization of the wastepaper and separation of the fibers from the ink-containing fines, it was found preferable to first shred the raw wastepaper feed into more manageable pieces prior to fiberization. For reasons of quality control and also because of a potential fire hazard within the fiberizer due to the presence of airborne cellulosic dust, it is necessary to remove all pieces of metal, such as staples, paper clips, etc., which are present in the raw wastepaper feed and which might spark a fire if fed into the fiberization apparatus. It is of course also desirable to remove any other undesirable non-paper materials such as glass, wood, stones, etc. Therefore a means for removing foreign matter from the shredded paper needed to be developed.

Prior art methods for separating dense materials from lighter materials are well known. For example, U.S. Pat. No. 3,907,670 to Fernandes teaches an apparatus for classifying a mixture of particulate solids as found in municipal refuse. The mixture of materials is blown through a slightly downwardly declined duct, at the end of which is a vertical duct which collects heavy materials. The lighter materials are airborne through an upwardly inclined duct. Any heavy materials which passed over the vertical duct (46) cannot be carried by the air up the incline and fall back down into the vertical duct.

U.S. Pat. No. 3,986,949 to Di Duca et al. and U.S. Pat No. 3,441,131 to Gebauer teach a similar method wherein forced air suspends and carries lighter materials in an upward direction while heavier materials, unable to be sustained by the air flow, drop into receptacles.

However, the prior art designs are not believed to be suitable for consistently removing relatively small particles such as paper staples, grains of sand, etc. from the shredded paper. This is due to the critical nature of the air velocity required to convey paper and yet permit the small particles to drop out. It is believed that such a critical air velocity could not be consistently maintained in the commercially available separators due to factors such as fluctuation in paper feed rates and the effect of turbulence on air flow uniformity. Therefore there is a need for an improved separation method to remove foreign matter from shredded paper.

SUMMARY OF THE INVENTION

In one aspect, the invention resides in an air separator for removing relatively dense foreign materials from shredded paper comprising: (a) an open-ended downwardly pitched inlet duct for receiving and conveying shredded paper; (b) a substantially horizontal outlet duct for conveying an airborne stream of retained shredded paper; and (c) a substantially vertical discharge duct for receiving the relatively dense foreign materials and deflecting them away from the shredded paper, said discharge duct having a cross-sectional area greater than the cross-sectional area of the inlet duct, wherein each of the abovesaid ducts is joined to the other two ducts at a common juncture and wherein the inlet duct and discharge duct are situated such that the inlet duct substantially projects onto a wall of the discharge duct. What is meant by "substantially projects" will be explained hereinafter with respect to FIG. 3 of the Drawing.

In a further aspect, the invention resides in a method for separating relatively dense foreign materials from shredded paper comprising: (a) feeding a mixture of shredded paper and relatively dense foreign materials into a downwardly pitched inlet duct and drawing the mixture with a downstream fan through the inlet duct in a first direction to a separation zone comprising the common juncture of the inlet duct, a substantially horizontal outlet duct, and a substantially vertical discharge duct; (b) abruptly diverting the direction of flow of the shredded paper at the separation zone to a second direction through the outlet duct, wherein the relatively dense foreign materials continue travelling in the first direction and are then deflected in a downward direction by a wall of the vertical discharge duct and thereby separated from the shredded paper.

These and other aspects of the invention will be described in greater detail with respect to the Drawing.

DETAILED DESCRIPTION OF THE DRAWING

Figure 1:
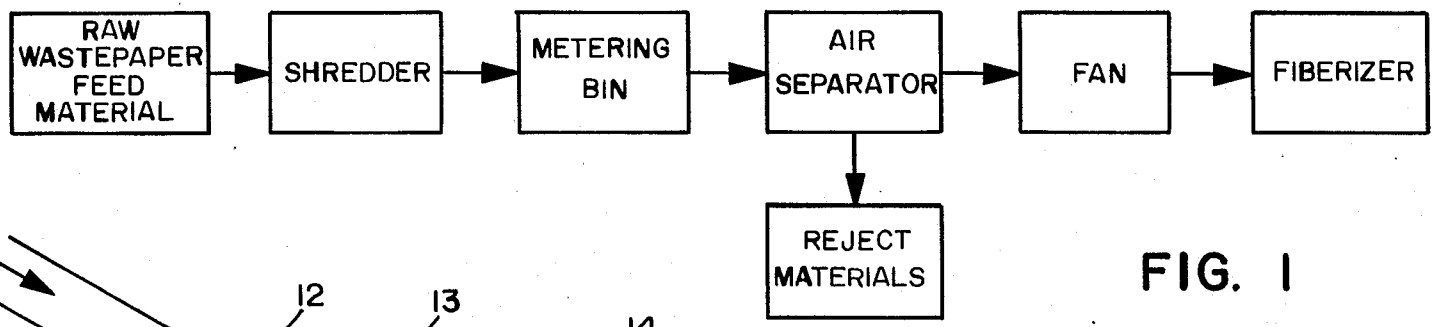
FIG. 1 is a block flow diagram for a paper treatment process for dry deinking of wastepaper incorporating the method and apparatus of this.

Directing attention to FIG. 1, the invention will be described in greater detail. FIG. 1 is a block flow diagram showing the use of this invention for removing unwanted, relatively dense materials from shredded paper. Shown is the raw wastepaper feed material, generally supplied in bale form, which is broken down and shredded in any of a variety of commercially available equipment sold for this purpose. The shredded paper is preferably thereafter stored in a metering bin to even out fluctuations in the wastepaper feed rate. (A more detailed discussion of the feed material shredding and the metering bin is provided in a commonly assigned copending application Ser. No. 700,076 filed Feb. 11, 1985, which is incorporated herein by reference.) The shredded paper, containing some dense foreign materials such as metal, wood, glass, stones, etc., is then deposited into the open end of the inlet duct of the air separator of this invention, which removes the relatively dense foreign reject materials and permits the low density, acceptable shredded paper to be continuously fed to the fiberizers for fiberization. The downstream fan serves to draw the shredded paper and foreign materials through the air separator and thereafter feed the shredded paper into the fiberizer. For purposes herein, when referring to the density of the materials in question, the single most important characteristic is not merely the density, but rather the ratio of the surface area of a particle to its weight. For example, shredded paper has a very high surface area:weight ratio, it being on the order of 9000 $in^2$/pound. On the other hand, the materials being separated from the shredded paper by the apparatus and method of this invention which are referred to herein as being relatively dense have surface area:weight ratios of about 550 $in^2$/pound or less. For example, paper clips have a surface area:weight ratio of about 55 $in^2$/pound, wood chips have a surface area:weight ratio of about 155 $in^2$/pound, stones having a ¼ inch diameter have a surface area:weight ratio of about 135 $in^2$/pound, and stones having a 1/16 inch diameter have a density of about 535 $in^2$/pound.

Figure 2:
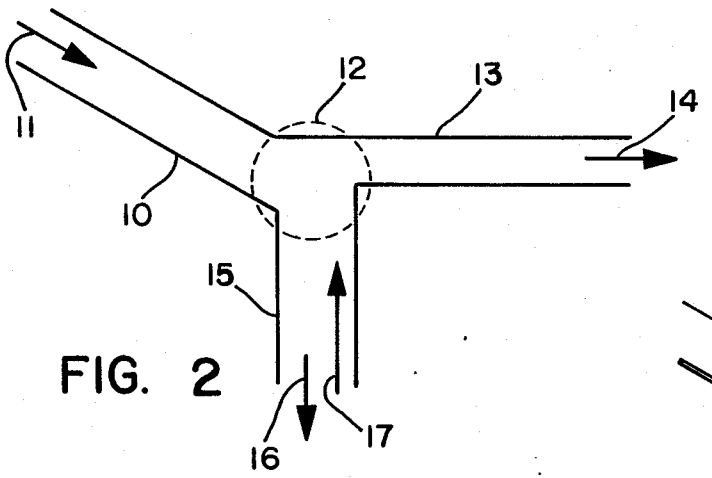
FIG. 2 is a schematic representation of an air separator of this invention.

FIG. 2 illustrates a preferred design of the air separator of this invention. Shown is the downwardly pitched inlet duct 10 into the open end of which the shredded paper feed material is deposited and conveyed as indicated by arrow 11. When fed from a metering bin, the outlet of which is at atmospheric pressure, the shredded paper is simply dropped into the inlet duct by gravity. The degree of downward pitch of the inlet duct is preferably about 30° from horizontal as shown, but it can be anywhere from about 20° to about 45° . The purpose of the downward pitch is to keep the more dense particles sliding down the inlet duct and to provide an appropriate angle relative to the wall of the discharge duct for proper deflection of the more dense particles. Hence the degree of downward pitch to some extent can depend on the shape and surface of the dense particles and the frictional forces between the surface of the inlet duct and the surface of the dense particles. As the material enters the inlet duct, the suction provided by the downstream fan accelerates the materials to a speed ranging from about 800 to about 3000 feet per minute. If the length of the inlet duct is sufficient, the more dense materials tend to gravitate and settle in the lower portion of the cross-sectional area of the inlet duct, while the shredded paper is more evenly distributed over the entire cross-sectional area. An inlet duct length of at least about 3 feet is necessary for this stratification to occur, and the length will depend on the degree of downward pitch of the inlet duct and the speed of the material through the inlet duct. The steeper pitches and greater speeds require greater lengths for stratification to occur. For a 30° downward pitch, a length of about 5 feet or greater is preferred, assuming material speeds in the range of 800–3000 feet per minute.

The portion of the separator designated as the "separation zone" is enclosed within the dashed-line circle 12, which is formed by the common juncture of the three ducts described herein. The shredded feed material entering the separation zone is split into two streams. The major portion of the material, which is the shredded paper, follows the abrupt change in direction of the air flow from downward to horizontal and passes through the horizontal outlet duct 13 and on through the fan to the fiberizer as indicated by arrow 14. The cross-sectional area of the outlet duct 13 at the separation zone is preferably less than that of the inlet duct in order to accelerate the air flow at that point to a reasonable transport velocity. However, this is a matter of choice and is not essential. The relatively dense foreign material is diverted into a vertical discharge duct 15 and removed from the system as indicated by arrow 16 and collected in a suitable receptacle. To facilitate retention of the less dense shredded paper, air drawn by the downstream fan is pulled upwardly through the open-ended vertical discharge duct, as shown by arrow 17, at a flow rate sufficient to retard or prevent the downward flow of the shredded paper, but not sufficient to prevent the downward travel of the relatively dense materials. For this reason the cross-sectional area of the discharge duct is preferably greater than that of the inlet duct. However, if the cross-sectional area is too small, the upward air speed will be too great and a fraction of the relatively dense materials may be carried upward and not separated from the shredded paper. If the cross-sectional area is too great, the upward air speed will be too low and some shredded paper may find its way out of the discharge duct.

Figure 3:
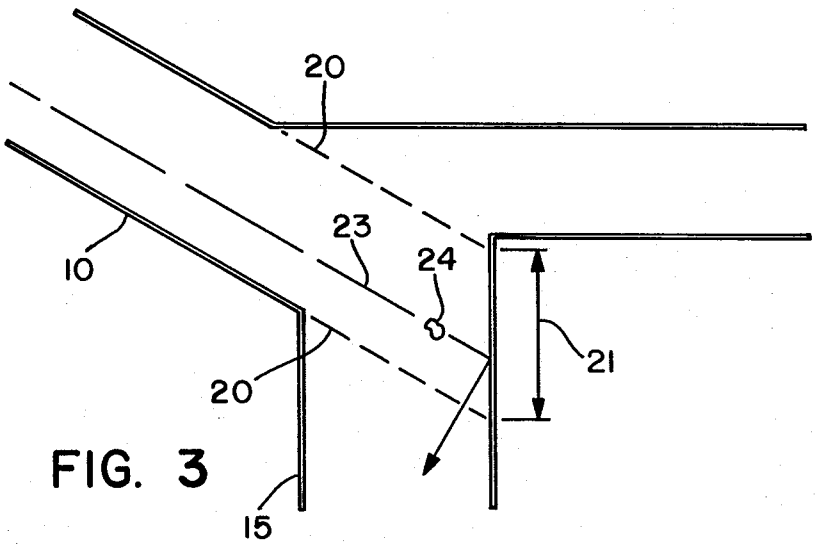
FIG. 3 is a further view of the same air separator, illustrating the separation of the relatively dense foreign materials from the shredded paper.

FIG. 3 further illustrates the operation of the air separator of this invention, particularly illustrating a critical spatial relationship between the inlet duct 10 and discharge duct 15. As previously mentioned, it is important that the inlet duct "substantially project" onto the wall of the discharge duct. This concept is illustrated by the dashed lines 20, which represent imaginary extensions of the inlet duct which project onto the area of the wall of the discharge duct designated by the double-ended arrow 21. The area where the inlet duct substantially projects onto the wall of the discharge duct represents the area where the relatively dense material will hit the discharge duct wall and, because of the proper angle between the inlet duct and the discharge duct wall, thereby deflect downward into the discharge duct. As previously mentioned, because of the length of the inlet duct, the relatively dense materials tend to gravitate to the lower portion of the inlet duct. The air separator of this invention is designed such that the trajectory of each particle of the relatively dense material intersects the wall of the discharge duct. Therefore the extent to which the inlet duct must project onto the wall of the discharge duct will depend upon the degree to which the relatively dense materials have stratified to the lower portion of the inlet duct. In any case, the inlet duct must substantially project onto the discharge duct wall. In terms of numbers, this would be expected to mean at least the lower 70 percent of the cross-sectional area of the inlet duct projects onto the discharge duct wall. The deflection of the relatively dense particles into the discharge duct is represented schematically by the illustrated path 23 of a relatively dense particle 24. FIG. 3 also illustrates 100 percent projection, which is preferred. In regard to the relative angles of the inlet duct and the wall of the discharge duct, the discharge duct is preferably substantially vertical, but can be oriented in any direction so long as the discharge duct wall angle is such as to deflect the relatively dense particles downwardly into the discharge duct and away from the outlet duct.

Hence there are several factors of this invention which combine in various ways to provide a very simple yet effective means for removing relatively dense material from shredded paper: (1) the downwardly inclined inlet duct and abrupt change in direction of flow as the shredded paper enters the outlet duct; (2) the free flow of air into the top end of the inlet duct; (3) the substantial projection of the inlet duct onto a wall of the discharge duct to present a surface which will deflect relatively dense particles downward through the discharge duct; (4) the greater cross-sectional area of the discharge duct relative to that of the inlet duct; (5) the upwardly flowing air through the discharge duct; and (6) the fact that the materials are drawn rather than forced through the separator. This last factor is very important because it maintains the correct proportion of air flows in the inlet duct and discharge duct to effect good material transport and separation.

As an example of the capabilities of the air separator of this invention, a separator was constructed in which the inlet duct was rectangular in cross-section measuring 4 inches high and 2 feet across, the outlet duct was rectangular in cross-section measuring 3 inches high and 2 feet across, and the discharge duct was rectangular in cross-section measuring 5 inches wide and 2 feet across. The inlet duct was downwardly inclined at an angle of 30° and was about 60 inches long. The outlet duct was smaller in cross-section than the inlet duct in order to create acceleration of the shredded paper at the point of separation. The outlet duct was connected to a downstream centrifugal fan, having a capacity of 0 to 5000 standard cubic feet of air per minute, which drew the materials through the air separator.

The air separator was fed shredded paper at estimated feed rates ranging from about 30 to about 70 pounds per minute. The air speed in the inlet duct was varied from 1500 to 3200 feet per minute by dampering the centrifugal fan. (The inlet duct and the discharge ducts remained fully open at their inlet and outlet ends, respectively.) This resulted in discharge duct updraft air speeds ranging from 1500 to 4300 feet per minute. At an estimated paper feed rate of 30 pounds per minute, the inlet duct air speed could be decreased to about 800 feet per minute before shredded paper began to fall out of the discharge duct. Relatively dense materials such as wood chips, paper clips, paper staples and pebbles as light as 0.05 gram were successfully removed at all feed rates tested.

The foregoing examples, given for purposes of illustration, are not to be construed as limiting the scope of this invention, which is defined by the following claims.

I claim:

1. An air separator for removing relatively dense foreign materials from shredded paper comprising:

(a) a downwardly pitched open-ended inlet duct for receiving and conveying shredded paper;

(b) a substantially horizontal outlet duct for conveying an airborne stream of retained shredded paper; and (c) a substantially vertical open-ended discharge duct for receiving the relatively dense foreign materials and deflecting them away from the shredded paper, said discharge duct having a cross-sectional area greater than the cross-sectional area of the inlet duct;

wherein each of the abovesaid ducts is joined to the other two ducts at a common juncture and wherein the inlet duct and discharge duct are situated such that the inlet duct substantially projects onto a wall of the discharge duct.

2. The separator of claim 1 wherein the inlet duct is pitched downwardly at an angle of from about 20° to about 45° below horizontal.

3. The separator of claim 2 wherein the inlet duct is pitched downwardly about 30° below horizontal.

4. The separator of claim 1 wherein the inlet duct completely projects onto the wall of the discharge duct.

5. The separator of claim 1 wherein the inlet duct is at least about 3 feet long.

6. The separator of claim 2 wherein the inlet duct is at least about 6 feet long and is downwardly pitched at an angle of about 30° below horizontal.

7. A method for separating relatively dense foreign materials from shredded paper comprising:

(a) feeding a mixture of shredded paper and relatively dense materials into a downwardly pitched open-ended inlet duct and drawing the mixture with a downstream fan through the inlet duct in a first direction to a separation zone comprising the common juncture of the inlet duct, a substantially horizontal outlet duct, and a substantially vertical open-ended discharge duct;

(b) abruptly diverting the direction of flow of the shredded paper at the separation zone to a second direction through the outlet duct, wherein the relatively dense materials continue travelling in the first direction and are deflected in a downward direction by a wall of the vertical discharge duct against an upward flow of air drawn by said fan and thereby separated from the shredded paper.

8. The method of claim 7 wherein the dense foreign materials are deflected in a downward direction against an upwardly flowing airstream drawn by the downstream fan at a rate sufficient to prevent shredded paper from passing downwardly through the discharge duct.

* * * * *